US008439721B2

(12) United States Patent
Sokolowski et al.

(10) Patent No.: US 8,439,721 B2
(45) Date of Patent: May 14, 2013

(54) GROOVED SUPPORT SPORT BRA

(75) Inventors: Susan L. Sokolowski, Portland, OR (US); Andrea J. Staub, Portland, OR (US)

(73) Assignee: Nike, Inc., Beaverton, OR (US)

( * ) Notice: Subject to any disclaimer, the term of this patent is extended or adjusted under 35 U.S.C. 154(b) by 269 days.

(21) Appl. No.: 12/907,482

(22) Filed: Oct. 19, 2010

(65) Prior Publication Data

US 2012/0094575 A1 Apr. 19, 2012

(51) Int. Cl.
*A41C 3/00* (2006.01)

(52) U.S. Cl.
USPC ..... 450/41; 450/39

(58) Field of Classification Search ..... 450/39, 450/37, 36, 54–58, 92, 93, 40, 41, 51–53
See application file for complete search history.

(56) References Cited

U.S. PATENT DOCUMENTS

| | | | | |
|---|---|---|---|---|
| 3,163,167 | A | 12/1964 | Chisholm | |
| 3,164,655 | A | 1/1965 | Howard | |
| 3,934,593 | A | 1/1976 | Mellinger | |
| 4,143,662 | A | 3/1979 | Fisher | |
| 4,289,137 | A | 9/1981 | Dell et al. | |
| 5,033,986 | A | 7/1991 | Feigenbaum et al. | |
| 6,165,045 | A | 12/2000 | Miller et al. | |
| 6,238,266 | B1 | 5/2001 | Vogt et al. | |
| 6,447,365 | B1 | 9/2002 | Powell et al. | |
| 6,572,437 | B1 | 6/2003 | Waitz | |
| 6,685,534 | B2 | 2/2004 | Mitchell et al. | |
| 6,811,464 | B2 * | 11/2004 | Li | 450/57 |
| 6,837,771 | B2 * | 1/2005 | Falla | 450/39 |
| 7,429,205 | B1 * | 9/2008 | Huang | 450/39 |
| 7,435,155 | B2 | 10/2008 | Reinisch et al. | |
| 7,435,156 | B1 * | 10/2008 | Liu | 450/92 |
| 7,690,965 | B2 * | 4/2010 | Falla et al. | 450/92 |
| 7,833,082 | B2 * | 11/2010 | Bugada | 450/39 |
| 8,113,908 | B1 * | 2/2012 | Modena et al. | 450/39 |
| 2002/0022433 | A1 | 2/2002 | Yeung et al. | |
| 2007/0021035 | A1 * | 1/2007 | Bugada | 450/39 |
| 2009/0098803 | A1 | 4/2009 | Reinisch et al. | |

OTHER PUBLICATIONS

The International Search Report and Written Opinion of PCT/US11/56882; dated Mar. 9, 2012.

* cited by examiner

*Primary Examiner* — Gloria Hale
(74) *Attorney, Agent, or Firm* — Shook, Hardy & Bacon L.L.P.

(57) ABSTRACT

Sport bras having one or more support grooves for lifting, separating, shaping a supporting a wearer's breasts and methods for fabricating these sport bra are described. The support grooves may be pressed into a layer of compressible material such that the support grooves extend from a central region along the wearer's sternum, curve underneath the breasts and extend upwardly towards the underarm region.

20 Claims, 6 Drawing Sheets

GROOVED SUPPORT SPORT BRA

SUMMARY

The invention is defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

Conventional sport bras typically compress and/or encapsulate the breasts of a female athlete to prevent excessive motion during athletic activities. Some sport bras utilize U-shaped underwires for support and breast separation. Underwires are generally formed from lengths of stiff metal or plastic materials stitched into the bottom of each cup of the bra such that the wire is adjacent to the wearer's ribcage. Such conventional underwires can cause discomfort by pressing into the flesh of the wearer during high intensity activities. In some instances, the tip of the underwire may penetrate its casing and cause chaffing or other discomfort. Sport bras containing underwires are often made using labor intensive cut-and-sew construction techniques where different materials and layers are pieced together. Further, the inclusion of an underwire in a sports bra adds weight to a garment, while many athletic activities such a sprinting, benefit from minimizing the weight of the equipment and apparel of an athlete. A bulky underwire may also restrict an athlete's range of motion when an athlete needs flexibility. As such, there is a need for a sport bra that provides support and motion control during athletic activities without the discomfort associated with a traditional underwire.

The present invention provides a sport bra having support grooves. In accordance with the present invention, the sport bra may have one or more support grooves pressed into a compressible material. The support grooves may partially surround each of a wearer's breast. In particular, the support grooves may extend from a central region along the wearer's sternum, curve underneath the breasts and extend upwardly towards the underarm region.

BRIEF DESCRIPTION OF THE SEVERAL VIEWS OF THE DRAWINGS

Examples of the present invention are described in detail below with reference to the attached drawing figures, which are incorporated by reference herein and wherein.

DETAILED DESCRIPTION

Figure 1:
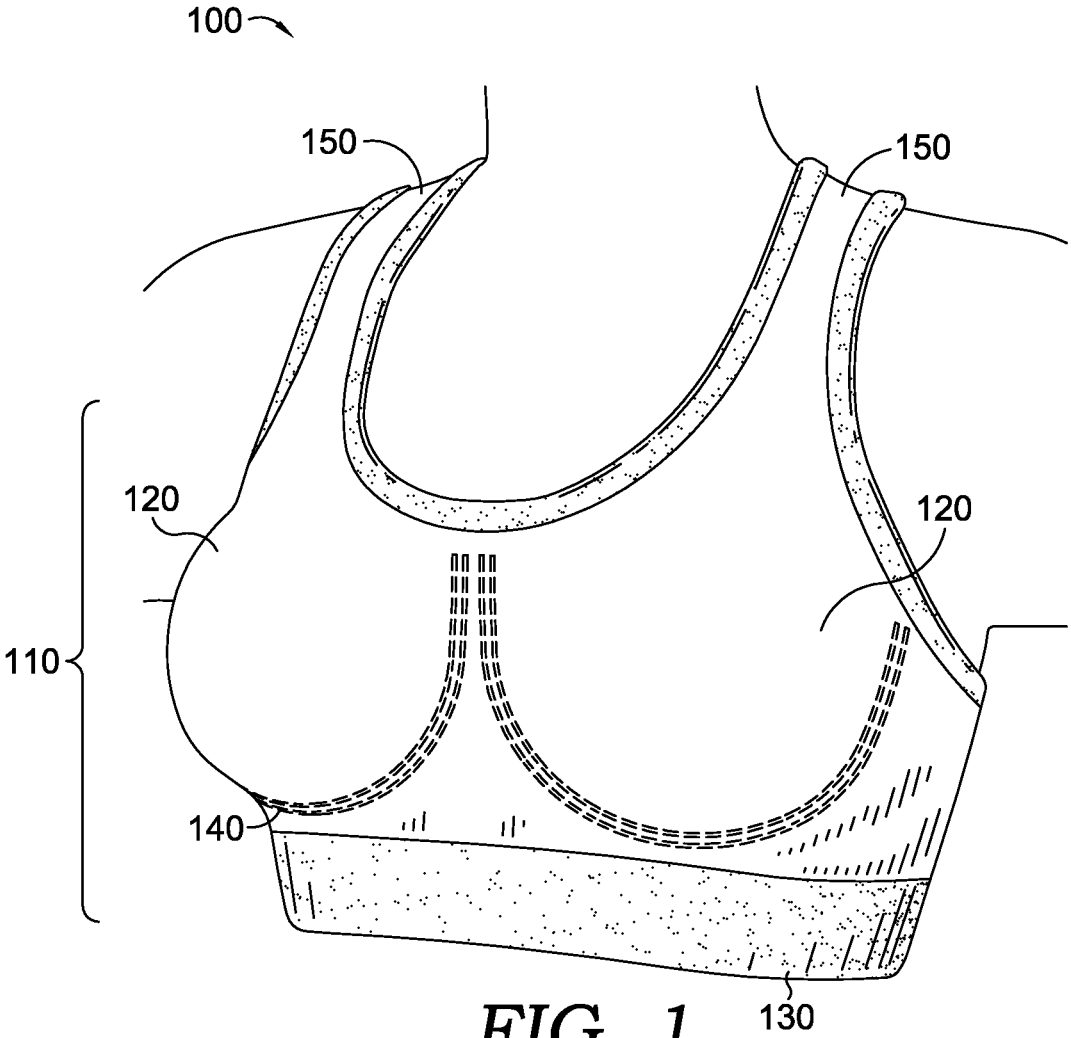
FIG. 1 depicts a perspective view of a sport bra embodying features of the present invention shown on a wearer.

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described.

The present invention relates to a sport bra having one or more support groove(s). The invention further relates to a method of fabricating a sport bra with one or more support groove(s). The sport bra in accordance with the present invention may have multiple layers of material. The support grooves may be pressed into a layer of compressible material.

Accordingly, in one aspect, the present invention provides a sport bra. The sport bra may include a first layer of compressible material. One or more support grooves may be pressed into the compressible material. Each of the support grooves may partially surround each of a wearer's breasts when the sport bra is worn. The sport bra may further include a second layer of material attached to the first layer of material, such that a portion of the second layer of material may be molded to form a pair of breast cups.

In another aspect, the present invention provides a sport bra that may include a front region that covers the wearer's breasts and at least a portion of the wearer's torso when the sport bra is worn. The front region of the sport bra may include one or more support groove(s) pressed into a compressible material. The support groove(s) may at least partially surround each of a wearer's breasts in an as worn position. The support groove(s) may extend from a central region between a wearer's breasts, curve underneath the breast and extend upwardly towards an underarm area of the wearer. In another aspect, the support groove(s) may extend from one side of a wearer's torso to the next, curving under each of the wearer's breast and being connected in a middle region between the breasts, when the sport bra is worn. The front region of the sport bra may further include a pair of breast cups, where one or more of the set of support grooves may be adjacent to the bottom edge of each of the pair of breast cups. The sport bra may further include a back region attached to the front region of the sport bra. The back region of the sport bra may have a racer back configuration and may cover at least a portion of the wearer's back when the sport bra is worn.

In another aspect an overall method of fabricating a sport bra in accordance with an embodiment of the present invention is provided. Materials for constructing a sport bra having one or more support groove(s) that partially surrounds each of a wearer's breasts are provided. The materials may include a compressible foam material. The support groove(s) may be pressed into one or more of the layers of compressible material such that the groove extends from side to side of a wearer's torso, curving under each of the wearer's breasts when the sport bra is worn. A pair of breast cups may be molded into the one or more layers of compressible material. The breast cups may be molded such that the support groove is adjacent to a bottom edge of each of the pair of breast cups. A front region of the sport bra may be cut. The front region of the sport bra may cover the wearer's breasts and at least a portion of the wearer's torso when the sport bra is worn. The front region may contain the support groove and the pair of breast cups. A back region of the sport bra may be cut and the front and back region of the sport bra may be attached.

Sport bras in accordance with the present invention may have support grooves pressed into a compressible material and methods for fabricating these sport bras. Having briefly described an overview of embodiments of the present invention, an exemplary sport bra having support grooves pressed into a compressible material is described below.

Referring to the drawings in general and FIGS. 1-4 in particular, an exemplary sport bra having at least one support groove pressed into a compressible material is depicted in various views. While embodiments discussed herein refer to sport bras, it will be understood that embodiments are not limited to any particular style or type of support garment used to support breast tissue during athletic activities. For example, other embodiments may include camisoles, swimwear or other garments with built in support. Further, the depictions in the drawings are for exemplary purposes only and are in no way meant to limit the scope of the present invention to any type of athletic activity.

Referring now to FIG. 1, a perspective view of an example sport bra embodying features of the present invention shown on a wearer is illustrated and designated generally as reference numeral 100. Sport bra 100, includes a front region 110, breast cups 120, rib band 130, support grooves 140 and shoulder straps 150. The front region 110 of sport bra 110 is the portion of the bra that covers a portion of the torso of the wearer. In embodiments, the front region 110 may be configured to be seamless. Front region 110 may include a pair of breast cups 120 which may be molded breast cups pressed into one or more layers of material forming the sport bra. Breast cups 120 may be designed to encapsulate each of the wearer's breasts and may be constructed of several layers of material molded at different depths. By way of example, the breast cups 120 may include an inner liner layer comprised of a soft material that comes in contact with the wearer's skin and/or an outer layer a form fitting material that compresses the breasts to provide motion control. Rib band 130 may be integrated into front region 110 and may extend around the circumference of the wearer's ribs as shown in FIG. 1.

Adjacent to the underside of breast cups 120 may be support grooves 140. The support grooves may be substantially U-shaped and may be configured to lift, separate, shape and/or provide support for a wearer's breasts. Support grooves 140 may extend from the central region of sport bra 100 between a wearer's breasts that covers a portion of the wearer's sternum. The support grooves 140 may curve underneath the bottoms of breast cups 120 and extend upwardly towards an underarm area of the wearer. In embodiments, support grooves 140 may be constructed by pressing the support grooves 140 into a compressible material layer of sport bra 100. The groove(s) 140 pressed into the material creates moderate rigidity at the groove(s) 140 sufficient to support breast tissue. By way of example, support grooves 140 may be pressed into a compressible foam material such as an ehtylene-vinyl acetate (EVA) foam or a similar foam material. Shoulder straps 150 may be formed integrally with front region 110 of the sport bra 100 and may extend upward from front region 110 and over the shoulders.

Figure 2:
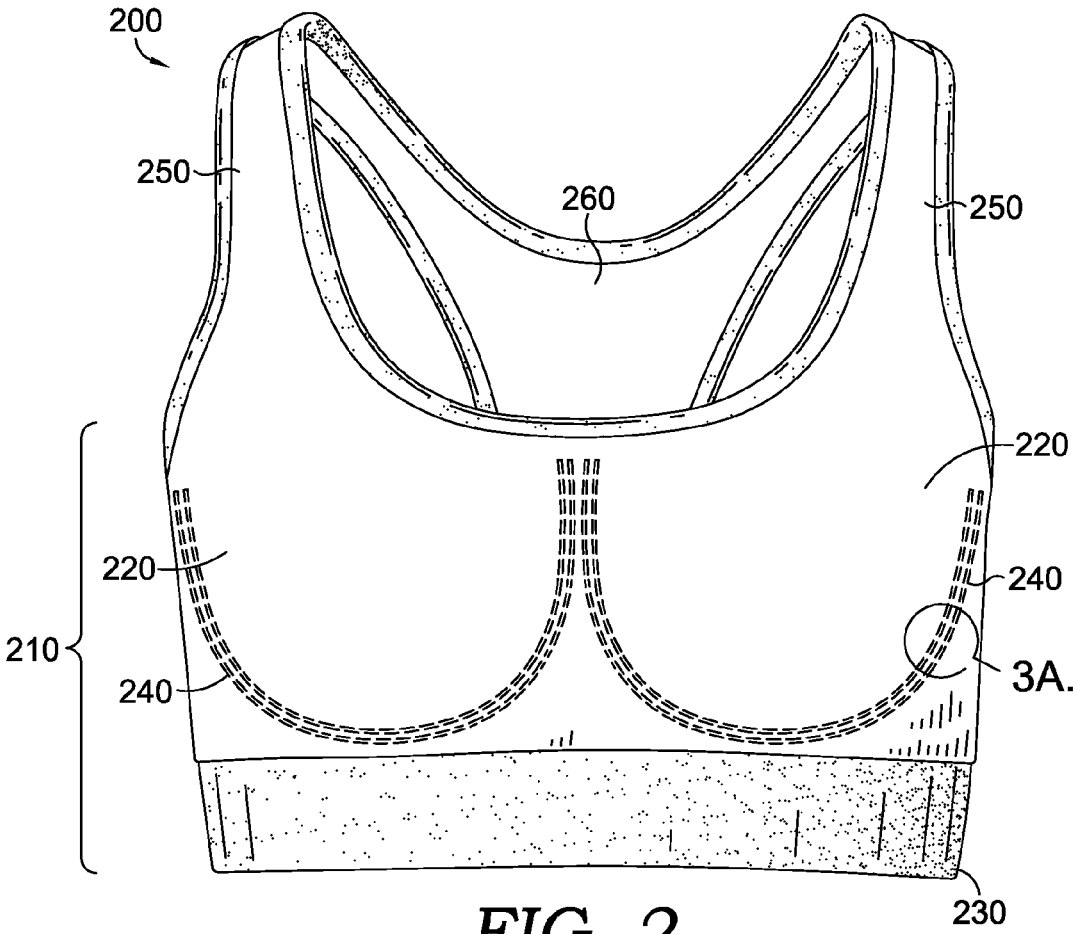
FIG. 2 depicts a front view of a sport bra embodying features of the present invention.

Turning now to FIG. 2, front view of an example a sport bra illustrating features of the present invention is shown and designated generally as reference number 200. Sport bra 200 may comprise front region 210, breast cups 220, rib band 230, support grooves 240, shoulder straps 250, and back region 260. Front region 210 may be constructed to cover a wearer's breasts and at least a portion of the wearer's torso. Sport bra 200 may be constructed from a compressible material. Several support grooves 240 may be configured to partially surround the breasts along the periphery of breast cups 220. The support grooves 240 may be pressed into a compressible material suitable for use in a sport bra. By way of example, sport bra 200 may include a compressible foam material containing support grooves extending along the sternum of a wearer. The support grooves 240 may curve underneath a breast and breast cups 220 and extend upwardly toward shoulder straps 250. Shoulder straps 250 may be formed integrally with front region 210 of the sport bra 200 and may extend upward from front region 210 and over the shoulders and downward to meet rib band 230 in the back region 260 of sport bra 200. Back region 260 may have a racer back configuration, although any other back configuration may be used. Shoulder straps 250 may also criss-cross in back region 260 to meet the rib band. The shoulder straps 250 may be fixed length, non-adjustable shoulder straps. Fixed length straps may be used when the sport is designed in a pull-over style. Alternatively, shoulder straps 250 may be adjustable to enable a wearer to customize the fit of the bra for comfort and a particular activity.

Figure 3A:
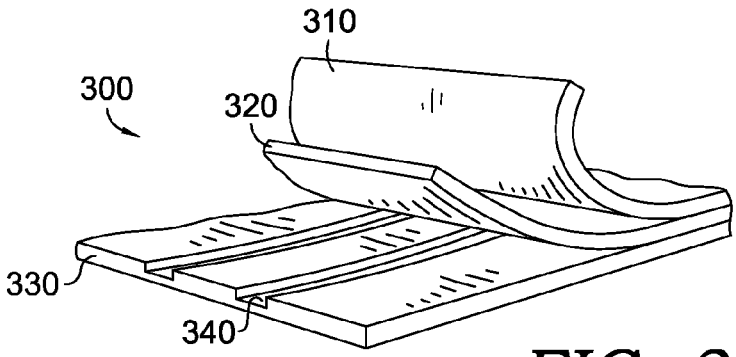
FIG. 3A depicts a cross-sectional view of the grooved support portion of a sport bra embodying features of the present invention.

Sport bra 200 may be may constructed from multiple layers of materials assembled to provide varying degrees of elasticity, reinforcement and compression. Turning now to FIG. 3A, a cross-sectional view of the grooved support portion of sport bra 200 is illustrated and designated generally as numeral 300. By way of example, sport bra 200 may include an inner layer 310, a middle layer 320 and an outer layer 330, although not all layers need be present in other configurations of sport bra 200. Inner layer 310 may line the sport bra 200 and comprise of a soft material that comes in contact with the wearer's skin. Inner layer 310 may also be configured to ventilate skin during activity and may include materials suitable to wick perspiration away from a wearer's skin. Middle layer 310 may include reinforcement material and may be non-stretch material depending on the characteristics desired at a particular location of the bra. Middle layer 310 may also include a bonding material to facilitate laminating the inner and outer layers of the sport bra. Outer layer 330 may include a compressible material containing one or more support grooves 340 pressed into layer 330. The compressible material used in outer layer 330 must be sufficiently malleable to facilitate impressing the support grooves 340, yet sufficiently rigid, once compressed, to form support grooves strong enough to support the breasts. By way of example, the layer containing support grooves 340 may be constructed from a compressible foam material or a three-dimensional mesh material. Other materials used during construction of sport bra 200 may include spandex, cotton, and nylon.

Figure 3B:
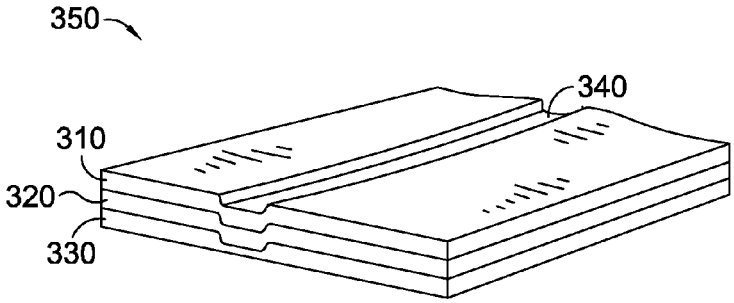
FIG. 3B depicts another cross-sectional view of the grooved support portion of a sport bra embodying features of the present invention.

While FIG. 3A depicts support grooves 340 in the outer layer 330, the support grooves 340 may be pressed into several layers of materials in the sport bra. By way of example, FIG. 3B depicts another cross-sectional view of a grooved support portion of a sport bra in accordance with the present invention is illustrated and designated generally as numeral 350. In FIG. 3B support grooves 340 are pressed into an inner layer 310, a middle layer 320 and an outer layer 330. Although three layers are depicted in FIG. 3A-3B, it is to be understood that more or fewer layers of materials may be used during construction of a sport bra in accordance with the present invention.

Figure 4:
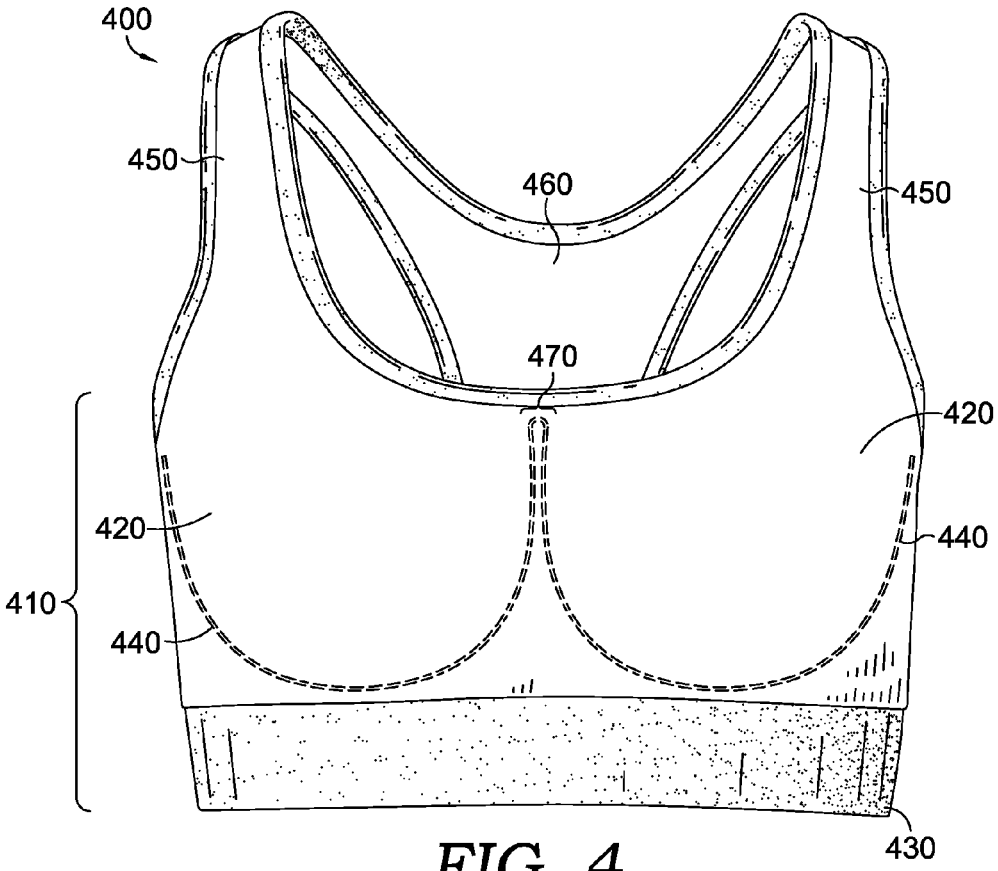
FIG. 4 depicts another front view of a sport bra embodying features of the present invention.

Turning now to FIG. 4, a front view of another example of a sport bra in accordance with the present invention is illustrated and designated generally as reference number 400. Sport bra 400 includes front region 410, breast cups 420, rib band 230, support groove 440, shoulder straps 450, and back region 460. Front region 410 may be constructed to a cover a wearer's breasts and at least a portion of the wearer's torso. Sport bra 400 may be constructed from a compressible material and may include a single continuous support groove 440 configured to partially surround the breasts along a portion of the periphery of breast cups 420. The support grooves 440 may be pressed into a compressible material suitable for use in a sport bra such that the support groove extends from one side of a wearer's torso to the next when the support bra is worn. As illustrated in FIG. 4 support groove 440 may curve under each of the wearer's breast and may be connected in a middle region 470 between the breasts. Support groove 440 may extend from middle region 470 along the sternum of a wearer, may curve underneath a breast and breast cups 420 and extend upwardly toward shoulder straps 450. Other configurations may be used in forming support groove 440. As shown in FIG. 4, the groove 440 may be connected in middle region 470 between the breasts. Middle region 470 may be positioned against the top of the sternum of the wearer when bra 400 is worn. In other examples, middle region 470 may be positioned against the bottom of the sternum of the wearer when bra 400 is worn. Shoulder straps 450 may be formed integrally with front region 410 of the sport bra 400 and may extend upward from front region 410 and over the shoulders and downward to meet rib band 430 in the back region 460 of sport bra 400. While the example of sport bra 400 refers to a sport bra having one continuous support groove 440, it will be understood that several configurations of support grooves may be used in a sport bra in accordance with the present invention. By way of example, sport bras in accordance with the present invention may comprise support groove configurations ranging from a single continuous groove to multiple unitary grooves, where each groove extends downward from the left underarm region along the bottom of the breast cups upward towards the right underarm region. Further examples of support groove configurations may be one pair of support grooves where each of the pair of support grooves are substantially U-shaped, extending from a central region between a wearer's breasts, curving underneath the breasts and extending upwardly towards an underarm area of the wearer. Alternatively, a sport bra in accordance with the present invention may comprise multiple pairs of substantially U-shaped support grooves.

Figure 5:
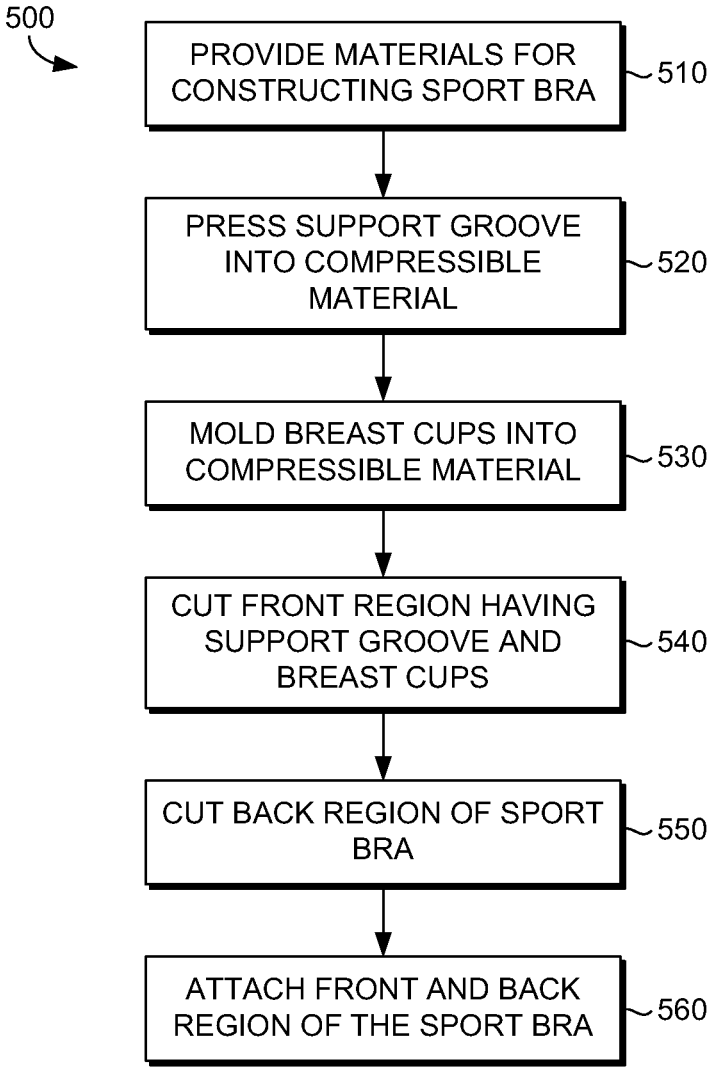
FIG. 5 depicts a block diagram of an overall method of fabricating a sport bra in accordance with an embodiment of the present invention.

Referring now to FIG. 5, a block diagram is provided that illustrates an overall method 500 of fabricating a sport bra in accordance with the present invention. Initially, as shown a block 510, materials for constructing a sport bra having a support groove that partially surrounds each of a wearer's breasts are provided. The materials may include a compressible foam material such as an EVA foam or a similar foam material and fabrics such as spandex, cotton, and nylon. The support groove may be pressed into one or more of the layers of compressible material, as shown at block 520. The support groove may be pressed so that the groove extends from side to side of a wearer's torso, curving under each of the wearer's breasts when the sport bra is worn. A pair of breast cups may be molded into the one or more layers of compressible material, as shown at block 530. The breast cups may be molded such that the support groove is adjacent to a bottom edge of each of the pair of breast cups. A front region of the sport bra may be cut, as shown at block 540. The front region of the sport bra may cover the wearer's breasts and at least a portion of the wearer's torso when the sport bra is worn. The front region may contain the support groove and the pair of breast cups. A back region of the sport bra may be cut, as shown at block 550. The back region of the sport bra may be cut from one or more layers of form-fitting material into a racer back configuration and may cover at least a portion of the wearer's back when the sport bra is worn. The front and back region of the sport bra may be attached, as shown at block 560.

Figure 6A:
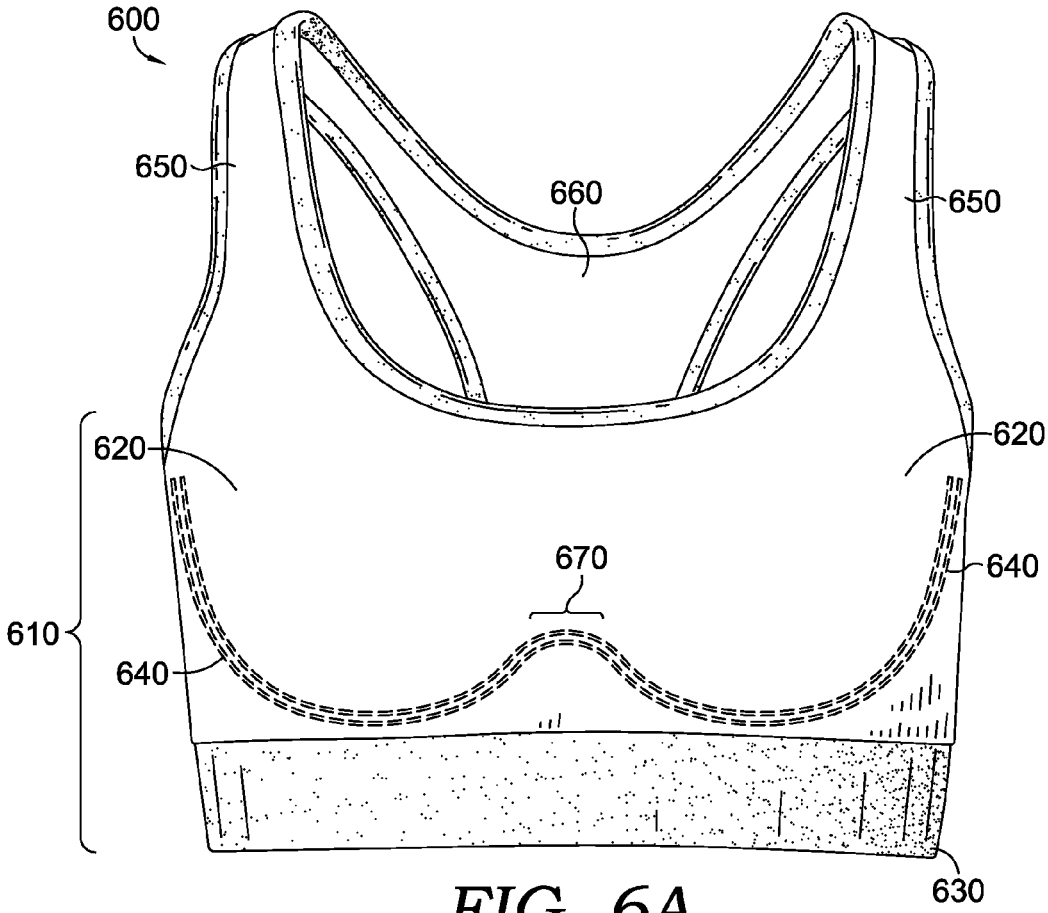
FIG. 6A depicts another front view of a sport bra embodying features of the present invention.
Figure 6B:
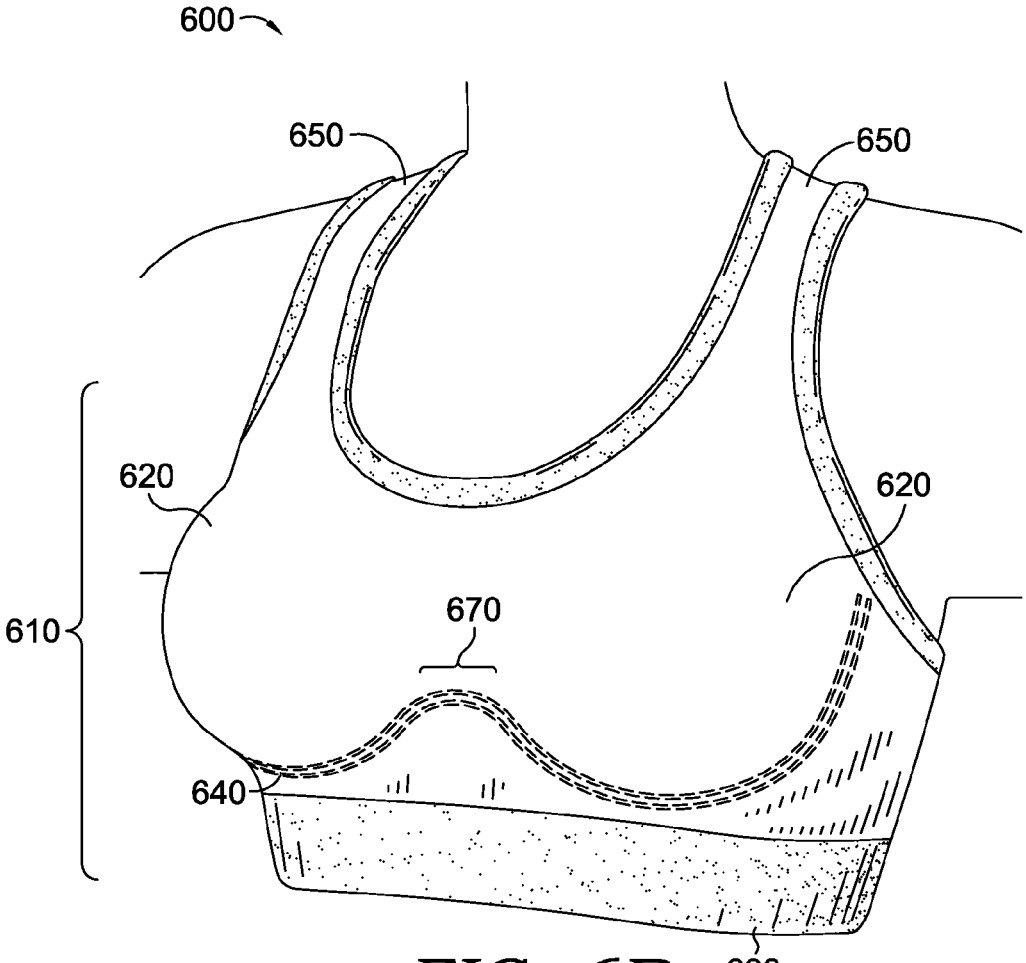
FIG. 6B depicts a perspective view of a sport bra embodying features of the present invention shown on a wearer.

Turning now to FIG. 6A, a front view of another example of a sport bra in accordance with the present invention is illustrated and designated generally as reference number 600. In FIG. 6B, a perspective view of an example sport bra embodying features of the present invention shown on a wearer is illustrated and designated generally as reference numeral 600. Sport bra 600 includes front region 610, breast cups 620, rib band 630, support groove 640, shoulder straps 650, and back region 660. Front region 610 may be constructed to a cover a wearer's breasts and at least a portion of the wearer's torso. Breast cups 620 may be designed to encapsulate each of the wearer's breasts and may be constructed of several layers of material molded at different depths. Sport bra 600 may be constructed from a compressible material and may include a single continuous support groove 640 configured to partially surround the breasts along a portion of the periphery of breast cups 620. By way of example, groove 640 may configured as a continuous groove extending from one side of a wearer's torso partially upwards between the wearer's breasts, and to the other side of the torso when the support bra is worn. The groove 640 may be connected in middle region 670 between the breasts. Middle region 670 may be positioned against the sternum of the wearer when bra 600 is worn, as illustrated in FIG. 6B.

Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

Embodiments of the present invention provide sport bras having support grooves pressed into a compressible material and methods for fabricating these sport bras. The sport bra in accordance with the present invention may also have layers of material that are laminated together. The support grooves may be pressed into a layer of compressible material such that the support grooves extend from a central region along the wearer's sternum, curve underneath the breasts and extend upwardly towards the underarm region.

The invention claimed is:

1. A sport bra comprising:

a first layer of compressible material having one or more unfilled support grooves pressed into the compressible material, each of the one or more unfilled support grooves at least partially surrounding each of a wearer's breasts when the sport bra is worn, wherein the first layer comprises an external-facing layer of the sport bra when in an as-worn position; and a second layer of material having a pair of molded breast cups, wherein the second layer is attached to the first layer.

2. The sport bra of claim 1, wherein the one or more unfilled support grooves are substantially U-shaped such that the unfilled support grooves extend from a central region of the sport bra between a wearer's breasts, curve underneath the pair of molded breast cups and extend upwardly towards an underarm area of the wearer.

3. The sport bra of claim 2, wherein the first layer of compressible material is constructed of a foam material or a three-dimensional mesh material.

4. The sport bra of claim 1, wherein the second layer of material is constructed of a form fitting material comprising one or more of spandex, cotton, or nylon.

5. The sport bra of claim 4, further comprising a third layer of material comprising an internal-facing layer of the sport bra when in an as-worn position.

6. The sport bra of claim 5, wherein the first, second and third layers of material are adhered together to form a front region of the bra that supports and covers the wearer's breasts and at least a portion of the wearer's torso when the sport bra is worn.

7. The sport bra of claim 6, wherein the first and third layers of material each comprises at least one element selected from the group consisting of Spandex, cotton and nylon.

8. The sport bra of claim 5, wherein the third material layer comprises a material configured to wick perspiration away from the wearer's skin during activity.

9. The sport bra of claim 6, wherein the front region of the bra that supports and covers the wearer's breasts and the at least the portion of the wearer's torso is seamless.

10. The sport bra of claim 6, further comprising a back region attached to the front region of the sport bra, wherein the back region has a racer back configuration and covers at least a portion of the wearer's back when the sport bra is worn.

11. A sport bra comprising:

a front region that covers the wearer's breasts and at least a portion of the wearer's torso when the sport bra is worn, wherein the front region comprises:

at least two unfilled support grooves pressed into a compressible material, the at least two unfilled support grooves at least partially surrounding each of a wearer's breast in an as worn position as thereunder, wherein the of at least two unfilled support grooves extend from a central region of the sport bra between a wearer's breasts, curve underneath the breast and extend upwardly towards an underarm area of the wearer;

a pair of breast cups, wherein the at least two unfilled support grooves are adjacent to a bottom edge of each of the pair of breast cups; and a back region attached to the front region of the sport bra, wherein the back region has a racer back configuration and covers at least a portion of the wearer's back when the sport bra is worn.

12. The sport bra of claim 11, wherein the compressible material is constructed of one or more layers of material comprising at least one of Spandex or foam.

13. The sport bra of claim 12, wherein the pair of breast cups is molded from a layer of the compressible material.

14. The sport bra of claim 12, wherein the front region of the bra is seamless.

15. The sport bra of claim 11, further comprising a pair of shoulder straps such that the pair of shoulder straps connect the front and back regions of the sport bra.

16. A method for fabricating a sport bra, the method comprising:

providing materials for constructing a sport bra, the materials comprising one or more layers of compressible material, and one or more layers of form-fitting material;

pressing an unfilled support groove into the one or more layers of compressible material such that the unfilled support groove extends from a first side of a wearer's torso, curves under each of the wearer's breast, connects in a middle region of the sport bra between the breasts, and extends to a second side of the wearer's torso when the sport bra is worn;

molding a pair of breast cups into the one or more layers of compressible material such that the unfilled support groove is adjacent to a bottom edge of each of the pair of breast cups;

cutting a front region in a shape that covers the wearer's breasts and at least a portion of the wearer's torso when the sport bra is worn, wherein the front region contains the unfilled support groove and the pair of breast cups, and wherein the front region includes a pair of integral shoulder straps, each shoulder strap extending upward from the front region and over the wearer's shoulders when the sport bra is worn;

cutting a back region from one or more layers of form-fitting material, wherein the back region covers at least a portion of the wearer's back when the sport bra is worn; and attaching the front region and back region of the sport bra.

17. The method of claim 16, further comprising utilizing a pair of shoulder straps to connect the front and back regions of the sport bra.

18. The method of claim 17, wherein the one or more layers of compressible material is constructed of a foam material.

19. The method of claim 18, wherein the one or more layers of compressible material is constructed of material comprising at least one element selected from the group consisting of Spandex or foam.

20. The method of claim 16, further comprising utilizing a bonding material to laminate a lining layer of material to the one or more layers of compressible material.

* * * * *